US005388520A

United States Patent [19]

Hammond et al.

[11] Patent Number: 5,388,520

[45] Date of Patent: Feb. 14, 1995

[54] INDIVIDUAL MINE LAUNCHER

[75] Inventors: Gabe B. Hammond; Richard A. Dunbar; Z. Y. Conner, all of Madison; Steven L. Stoner; Ronald A. Jasper, both of Hanover, all of Ind.

[73] Assignee: The United States of America as represented by the Scretary of the Army, Washington, D.C.

[21] Appl. No.: 130,939

[22] Filed: Oct. 4, 1993

[51] Int. Cl.[6] ..... F42C 17/00; G01M 19/00

[52] U.S. Cl. ..... 102/293; 73/167; 89/6.5

[58] Field of Search ..... 102/293; 89/6.5, 6; 73/167

[56] References Cited

U.S. PATENT DOCUMENTS

| | | | |
|---|---|---|---|
| 3,597,969 | 8/1971 | Curchack | 73/167 |
| 3,693,432 | 9/1972 | Stewart et al. | 73/167 |
| 3,986,394 | 10/1976 | Greenlees | 73/167 |
| 4,022,102 | 5/1977 | Ettel | 89/6.5 |
| 4,280,355 | 7/1981 | Donnally et al. | 73/167 |
| 4,649,796 | 3/1987 | Schmidt | 73/167 |
| 4,776,277 | 10/1988 | Fiedler et al. | 102/293 |
| 4,951,644 | 8/1990 | Bon | 124/75 |

*Primary Examiner*—David Brown

*Attorney, Agent, or Firm*—Freda L. Krosnick; Frank J. Dynda

[57] ABSTRACT

An individual mine launcher is designed to pneumatically launch high explosive VOLCANO and MOPMS mines to simulate flight and impact typically encountered in field use. Electronic components and controls are used to monitor and initiate the arming sequence of the mine. Two configurations are used with the same pneumatic and electronic controls. The air-launch configuration allows the mine to be launched into the air at various specified testing elevation angles. The control impact configuration shoots the mine into a chamber where the mine hits an impact surface and then falls into a test monitoring area below.

15 Claims, 14 Drawing Sheets

INDIVIDUAL MINE LAUNCHER

BACKGROUND OF THE INVENTION

1. Field of the Invention

This invention relates to an apparatus for pneumatically launching high explosive VOLCANO and MOPMS mines in order to simulate flight trajectories and impacts typically encountered in field use.

2. Description of Related Art

VOLCANO and MOPMS mines are cylindrically shaped high explosive devices which can be used as either anti-tank (AT) or anti-personnel (AP) weapons. In order to test the mines, the mines must be launched in a manner which simulates field conditions while maintaining the capability of performing required measurements and ensuring safety.

Two general types of launch configurations are required for testing VOLCANO and MOPMS mines. The first is the air-launch configuration, in which the mine is launched into the air at various specified testing elevation angles. The second is the control-impact configuration, in which the mine is shot into a chamber where it hits an impact surface and then falls into a trapped area. The mines must be monitored for timing of various functions in the arming sequence and tested for impact survival.

At present, no launchers suitable for testing individual VOLCANO and MOPMS mines exist. A prior mine launcher was developed to launch box-shaped GATOR mines into an impact chamber, through a drop chute to a test cell area. The prior GATOR mine launcher mine required a rectangular rather than a cylindrical launch tube, however, and was not suitable for VOLCANO and MOPMS type mines because of changes in arming methods and testing specifications.

SUMMARY OF THE INVENTION

It is accordingly an objective of the invention to provide an individual mine launcher capable of launching high explosive VOLCANO and MOPMS mines in order to simulate field conditions while performing required measurements and ensuring safety.

BRIEF DESCRIPTION OF THE DRAWINGS

FIG. 19(*b*) is a side view of the breech assembly of FIG. 19(*a*).

FIG. 20(*b*) is a plan view of a top for the link housing for the breech assembly of FIGS. 19(*a*)and 19(*b*).

FIG. 20(*c*) is a plan view of a side for the link housing of the breech assembly of FIGS. 19(*a*) and 19(*b*).

FIG. 20(*d*) is a plan view of a top cleat for the link housing of the breach assembly of FIGS. 19(*a*) and 19(*b*).

FIG. 24(*b*) is an elevated end view of the breech and lift block assembly of FIG. 24(*a*).

FIG. 25(*b*) is an elevated end view of the lift block of FIG. 25(*a*).

FIG. 28(*b*) is an elevated top view of the paddle of FIG. 28(*a*).

FIG. 28(*c*) is an elevated end view of the paddle of FIG. 28(*a*).

FIG. 29(*b*) is an elevated end view of the bottom piece of FIG. 29(*a*).

DETAILED DESCRIPTION OF THE PREFERRED EMBODIMENTS

Figure 1:
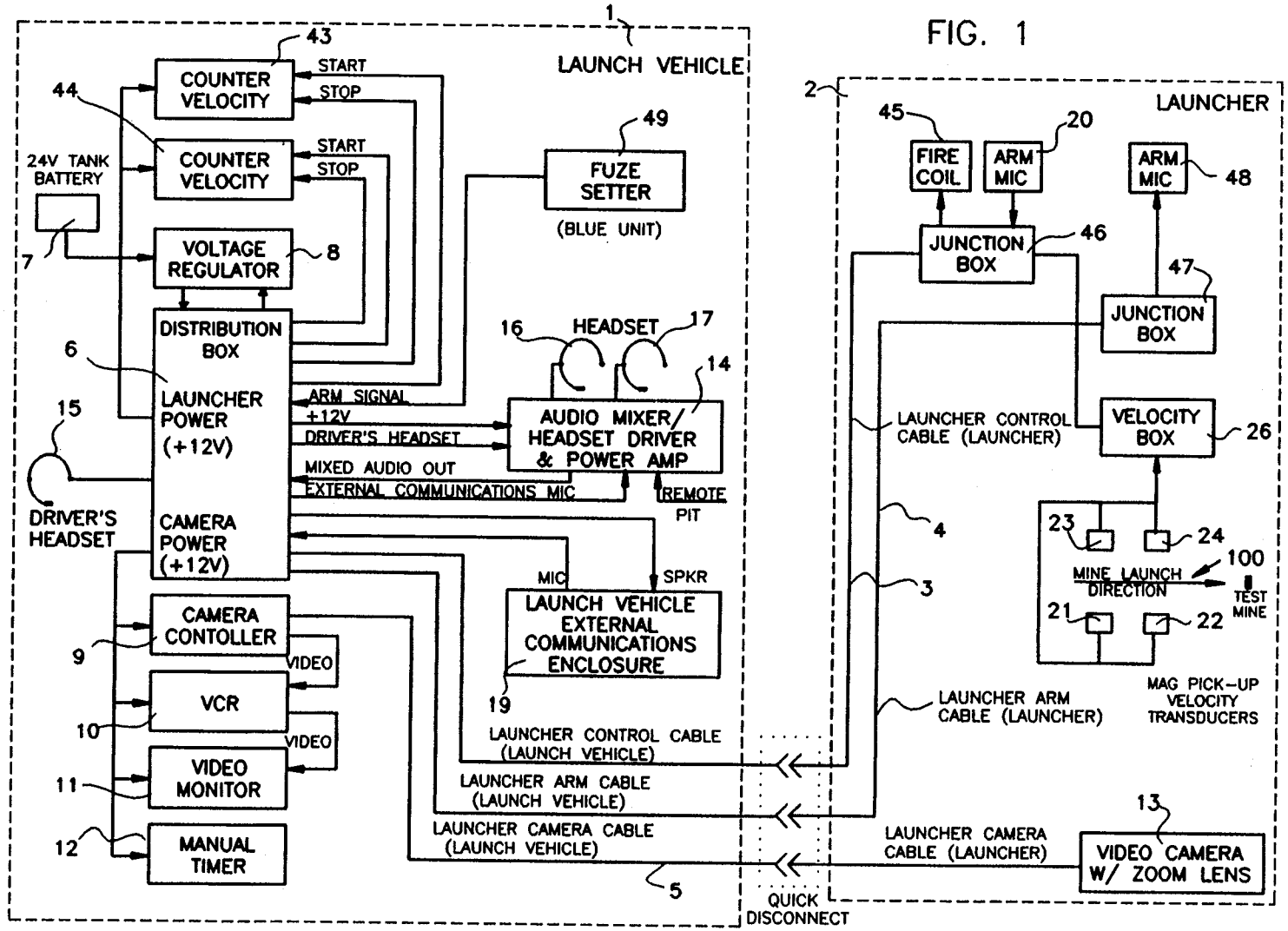
FIG. 1 is a block diagram of an individual VOLCANO mine launcher arranged in accordance with a preferred embodiment of the invention.
Figure 2:
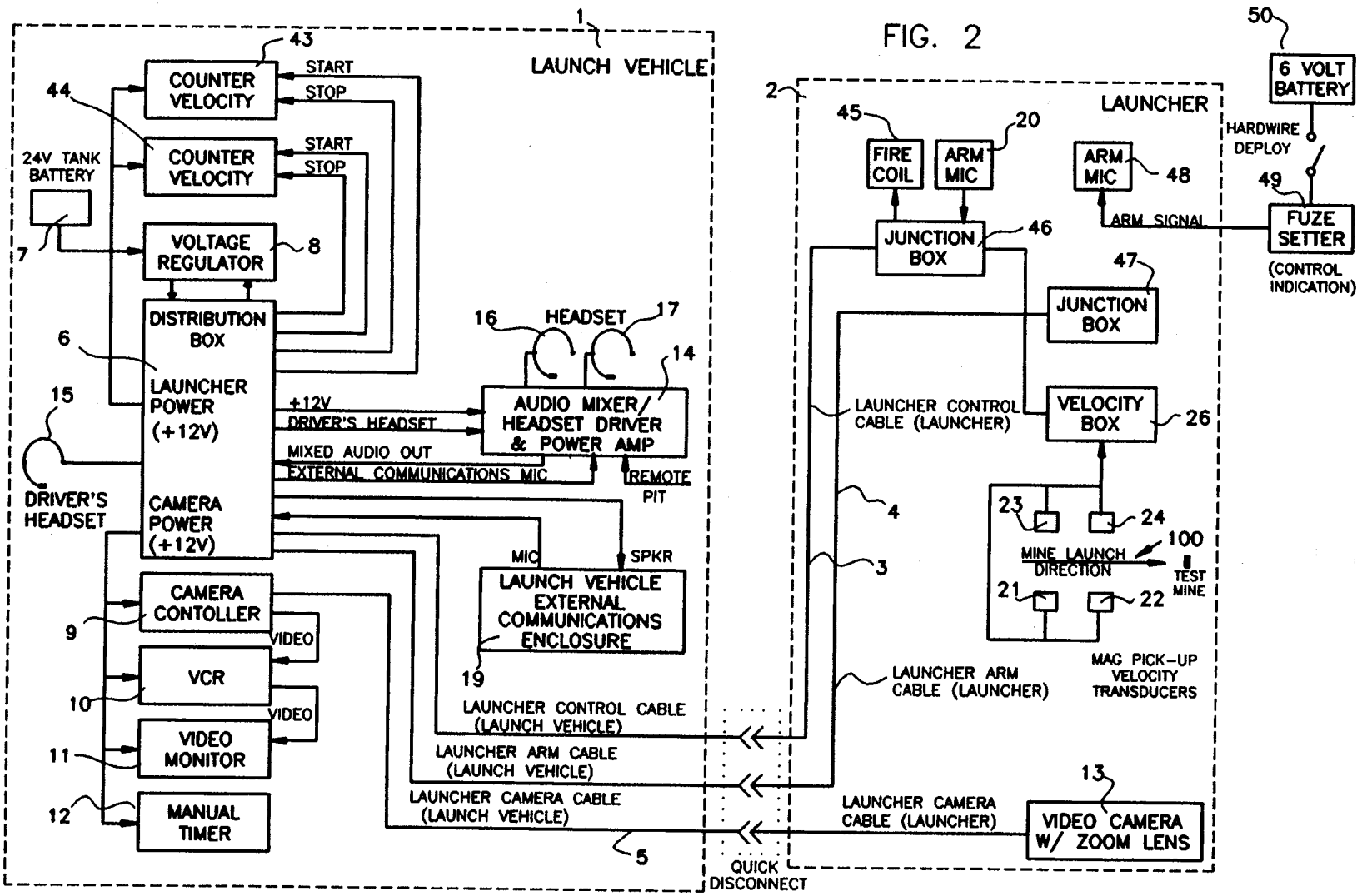
FIG. 2 is a block diagram of an individual MOPMS mine launcher arranged in accordance with the preferred embodiment of the invention.

As shown in FIGS. 1 and 2, an individual mine launcher according to a preferred embodiment of the invention includes a launch vehicle 1 and a launcher 2. The launch vehicle 1 communicates with the launcher 2 via three quick disconnect cables, including a launcher control cable 3, a launcher arm cable 4, and a launcher camera cable 5. The mine launcher shown in FIG. 1 is configured for VOLCANO mines while the launch vehicle shown in FIG. 2 is configured for MOPMS mines.

Launch vehicle 1 is similar to the mobile launch vehicle previously used to launch GATOR mines, including an armored cab for housing the necessary control systems while protecting the test operator during launch simulations. By utilizing quick disconnect cables, the launcher may be used with or without the launch vehicle, and the launch vehicle may be used with different launcher configurations as required for testing different types of mines.

The launch vehicle 1, as shown in FIGS. 1 and 2, includes a power distribution box 6 connected to receive power from, for example, a 24V tank battery 7 via a 12V voltage regulator 8. Power distribution box 6 distributes power to a video circuit which includes a camera controller 9, a video cassette recorder 10 for recording tests for subsequent analysis, a video monitor 11 for directly monitoring the test, and a timer 12. The video circuit is connected by camera cable 5 to a video camera 13 which is positioned on the launcher 2, and preferably includes a zoom lens controlled by controller 9. The distribution box 6 is also provided with audio input and output connections for a headset driver 14 which enables communications through headsets 15–17. Communications external to the launch vehicle are provided by an external communications enclosure 19. Monitoring of audible signals generated by a microphone 20 adjacent the arming mechanism, as described below, is carried out through headsets 16 and 17, the signals from microphone 20 being transmitted by quick disconnect cable 3.

Velocity transducers 21–24 are located near the exit of a launching tube 100 provided on the launcher and described in greater detail below. Two of the transducers are used for the start time of a velocity measurement and two are used for the stop time in order to enable redundant monitoring of the velocity of a mine during launch.

Figure 3:
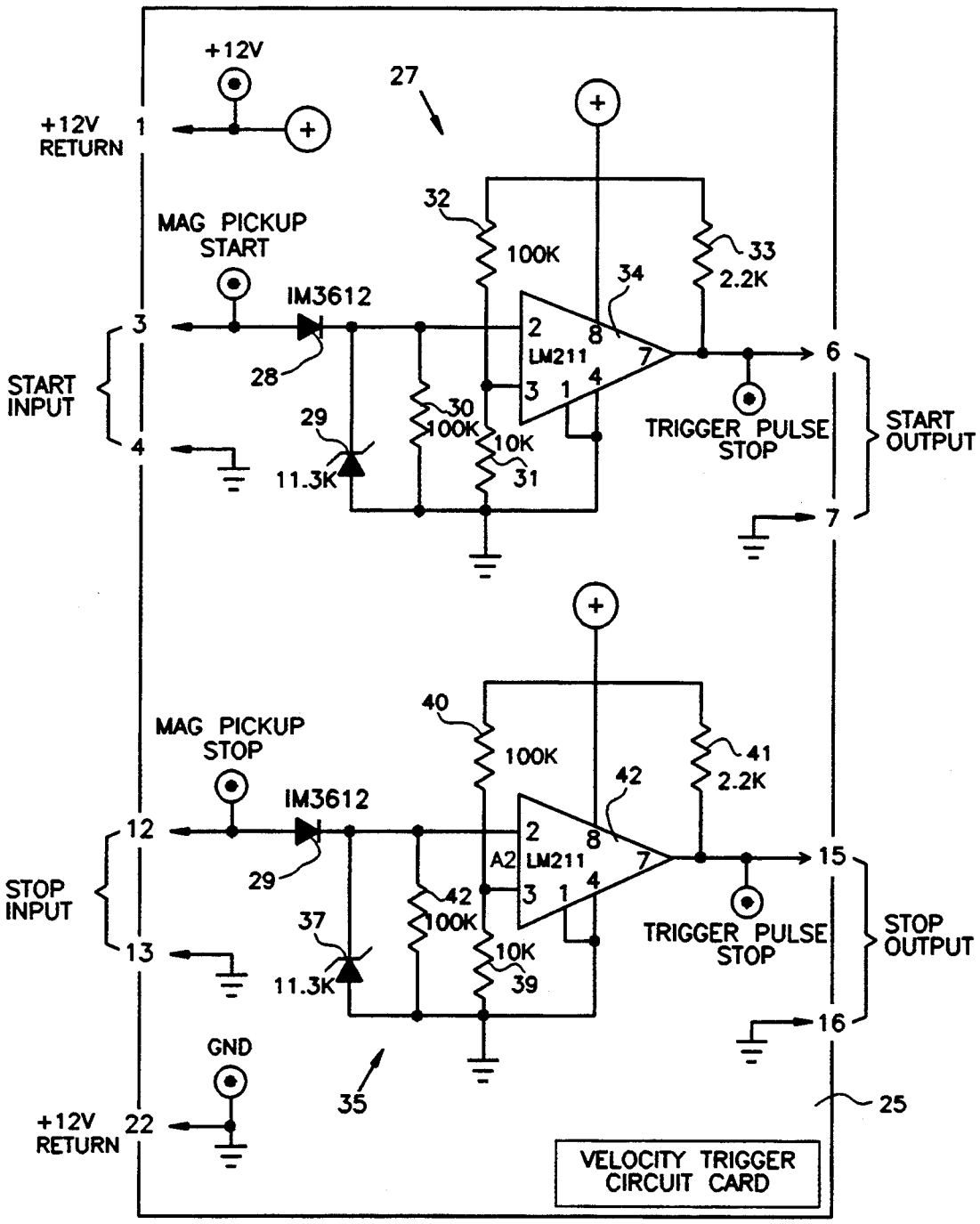
FIG. 3 is a schematic circuit diagram of a velocity trigger circuit card for the mine launcher of FIGS. 1 or 2.

The four velocity transducers 21–24 are connected to a circuit card 25 mounted in velocity junction box 26 on the launcher 2. As shown in FIG. 3, start time transducers 21 and 23 are each connected to a trigger pulse generating circuit 27 which includes diode 28, zener diode 29, resistors 30–33, and op amp 34. Stop time transducers 22 and 24 are connected to identical pulse generating circuits 35, including diode 36, zener diode 37, resistors 38–41, and op amp 42. In this example, the sensors are Model 3030 sensors provided by Electro Corp. of Sarasota, Fla. However, it will be appreciated by those skilled in the art that a variety of alternative velocity transducer arrangements may be substituted for the Electro Corp. sensors, with modifications to the sensor circuitry as appropriate. The velocity signals are transmitted to dual redundant velocity counters 43 and 44 via quick disconnect launcher control cable 3.

As shown in FIG. 1, a separate junction box 47 connects the VOLCANO mine arming coil 48 to quick disconnect cable 4, the arming signal being generated in launch vehicle 1 by fuze setter 49, which is connected to cable 4 through distribution box 6. However, as shown in FIG. 2, a modified arming coil 48′, shown in FIGS. 32 and 33 and described in detail below, is required for MOPMS launches. Arming coil 48′ is set by fuze setter 49′ powered by a separate 6V battery 50.

The electrical control lines on the launcher chassis require 19-pin quick disconnect connectors and are preferably threaded through conduits mounted on the chassis. A tee junction box 46 near the rear of the chassis distributes control lines to firing coil 45 of a solenoid operated air valve used to activate the air cylinder that triggers the launch. Other lines are distributed from junction box 46 to the arming microphone 20, which is in the launcher pressure chamber assembly, and to velocity junction box 26 for velocity measurements.

The launching tubes, designated collectively by reference numeral 100 in FIGS. 1 and 2, are close fitting cylinders adapted specifically to accommodate VOLCANO and MOPMS mines. The MOPMS launch tube is interchangeable on either the air-launch or the control-impact launching configurations, while different VOLCANO launch tubes are provided for each configuration.

Figure 4:
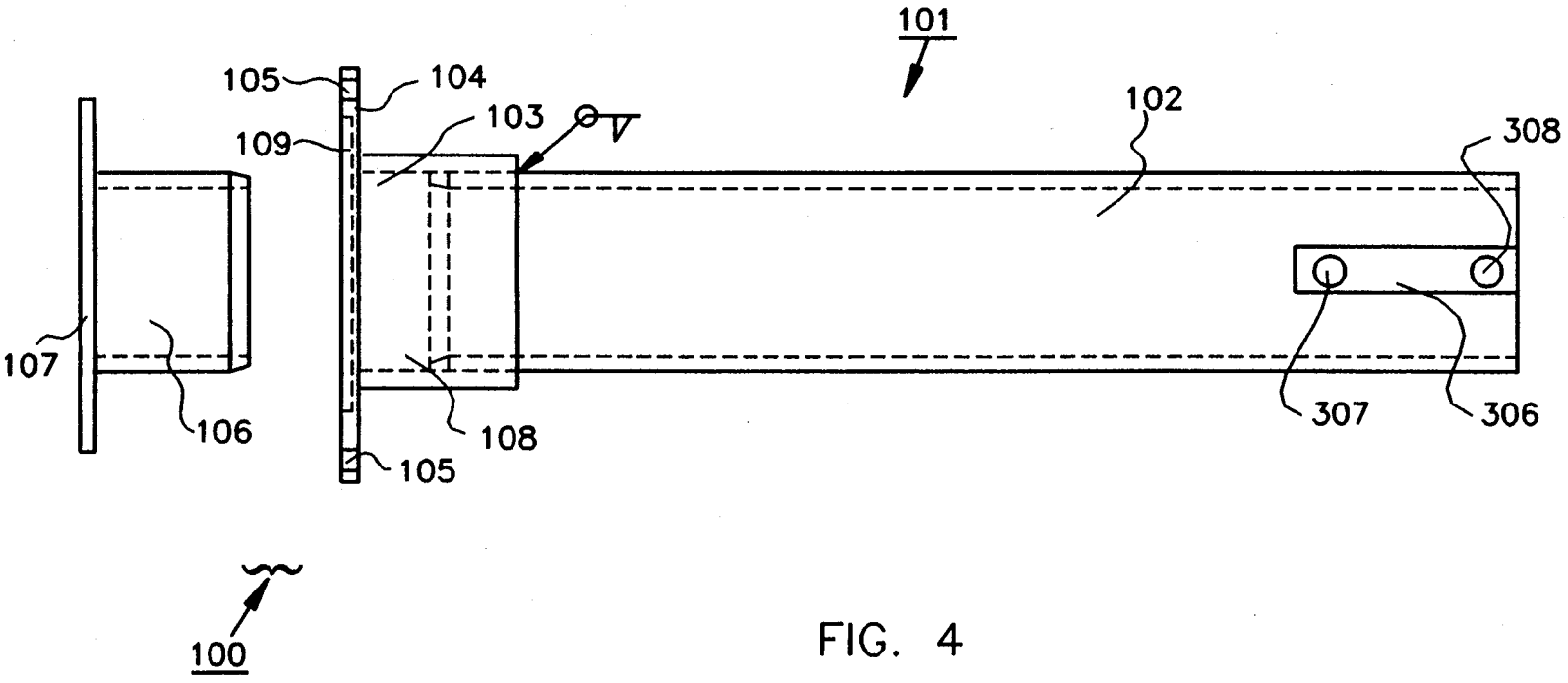
FIG. 4 is an elevated side view of a preferred breech and launcher tube assembly for air-launching VOLCANO and MOPMS mines, and for control-input launching MOPMS mines.

The basic launcher tube for volcano air-launch and MOPMS air launch and control-impact launch configurations, but not for the VOLCANO control-impact launch configuration, includes a breech and tube assembly 101, shown in FIG. 4, made up of a single pipe 102 fitted at one end within a breech tube 103 having a flange 104 through which two mounting/positioning holes 105 are drilled for positioning the launcher tube on a pressure chamber. A breech ring assembly includes a tube 106 and a flange 107 which fit respectively within corresponding opening 108 in tube 103 and opening 109 in flange 104.

The dimensions of the launcher tube components depend on whether the tube is to be used for VOLCANO or MOPMS launches, as will be appreciated by those skilled in the art, but both types of mines are in the shape of a cylinder approximately 5 inches in diameter and approximately three inches high, and thus the inner diameter of tube 102 and breech ring assembly tube 106 is preferably approximately five inches, while the length of tube 106 is three inches. Tube 102 is approximately 27 inches in length. Velocity sensors 21–24 are positioned on opposite sides of the tube by plates 306, only one of which is shown in FIG. 4. Plates 306 include tap holes 307 and 308 spaced approximately six inches apart for the sensors.

Figure 5:
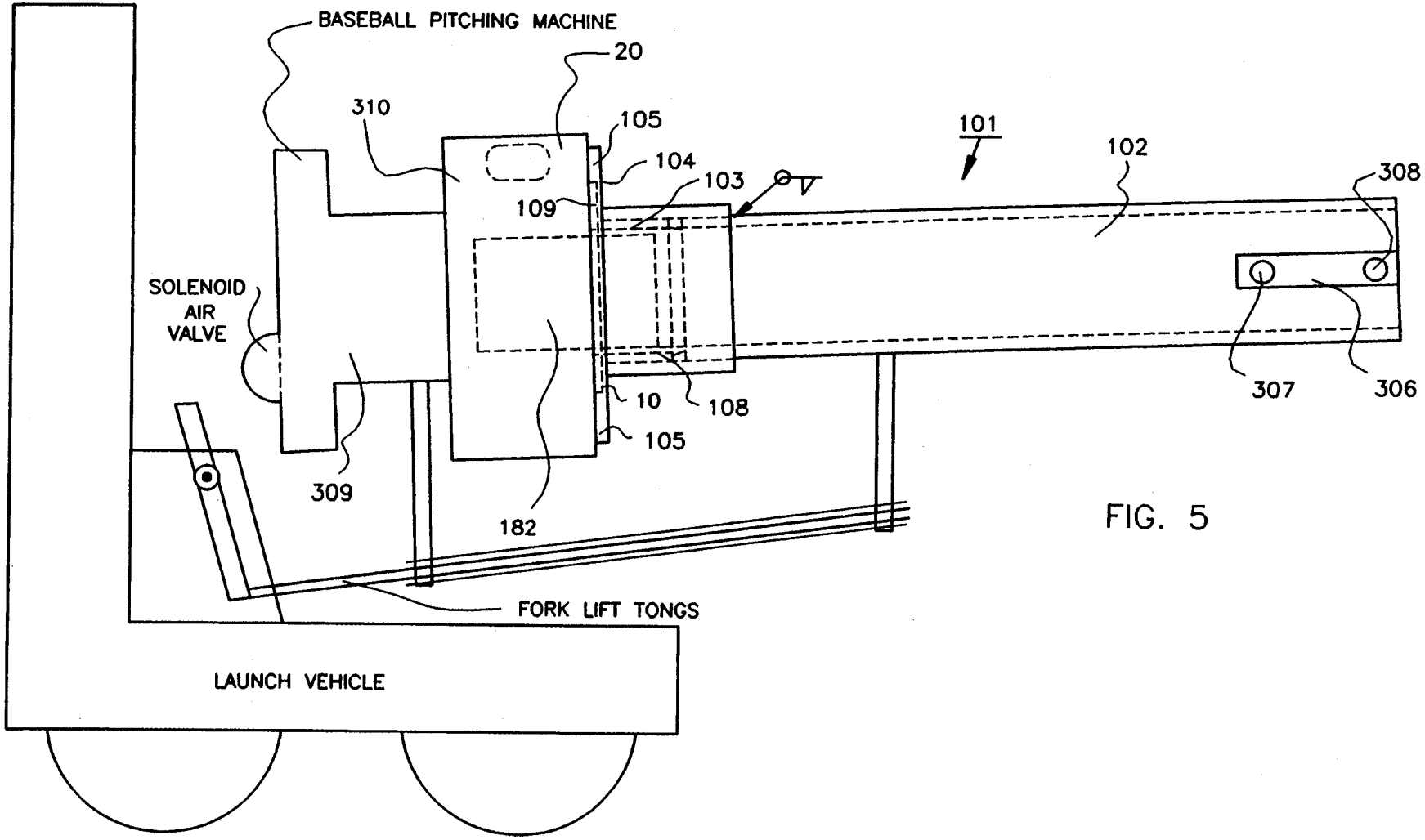
FIG. 5 is an elevated side view of the launcher tube assembly of FIG. 4, in position on a pressure chamber.

The pressure chamber assembly is, as shown in FIG. 5, preferably made of the cylinder 309 of a pneumatic baseball pitching machine which supplies launching power via the solenoid operated air valves distributed by junction box 46 and activated through quick disconnect cable 3. The same model of cylinder was also used on the previously built GATOR launcher. Reference numeral 300 denotes either a VOLCANO or MOPMS mine. Microphone 20 may be placed in an adapter ring 310 fitted on the pressure chamber assembly cylinder to monitor the mine for clicking sounds which occur in the arming sequence of the mine. The support chassis (not shown) for the launcher tube and the pressure type assembly is preferably constructed to be carried by fork lift tongs on the launch vehicle 1 in order to enable testing of high explosive mines at an outdoor test site where rapid evacuation is possible. If for example, a live mine becomes stuck in the launcher hardware, the operator could separate the launch vehicle from the launcher and leave the launcher on the field without leaving the safety of the instrumentation vehicle 1. In addition, casters (not shown) are preferably provided on the chassis to allow the launcher 2 to be positioned manually when testing non-high explosive mines at, for example, an indoor test facility.

Figure 33:
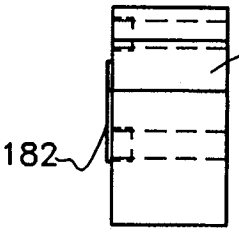
FIG. 33 is an elevated side view of the arming coil and spacer assembly of FIG. 32.
Figure 32:
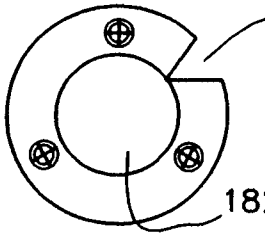
FIG. 32 is an elevated end view of a preferred arming coil and spacer assembly for an MOPMS mine.

When launching MOPMS mines, a modified coil and spacer assembly 180 as shown in FIGS. 32 and 33 is required. The modified coil and spacer assembly 180 includes a disk-shaped plexiglas encased coil mounted on the front and center of the pressure chamber, the MOPMS mine fitting snugly in the breach of the launcher tube. A groove 181 is provided for accommodating the coil leads. As the mine loaded launcher tube is clamped over the front of the pressure chamber, the mine is pressed against the coil 182 on the face of the modified coil and spacer assembly. For VOLCANO mines, the arming coil is set by the timer, either before or during launch depending on tube configuration. The launcher tubes are preferably mounted on rollers (not shown) that allow the tubes to be rolled away from the pressure chamber while inserting a mine. The tube is then clamped tightly to the pressure chamber with three clamps (not shown) mounted on the chamber.

Figure 6:
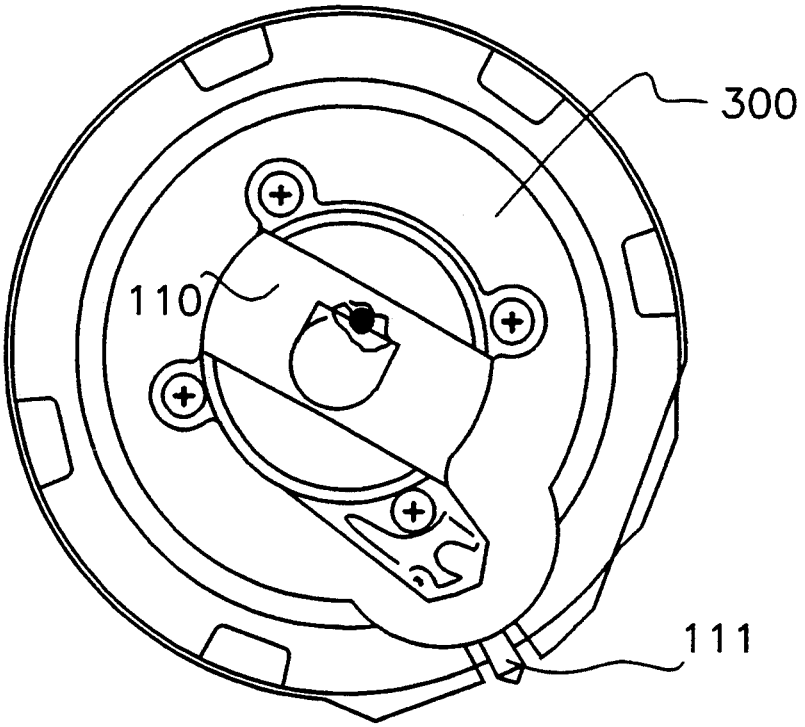
FIG. 6 is an elevated end view of a volcano mine with timer.
Figure 7:
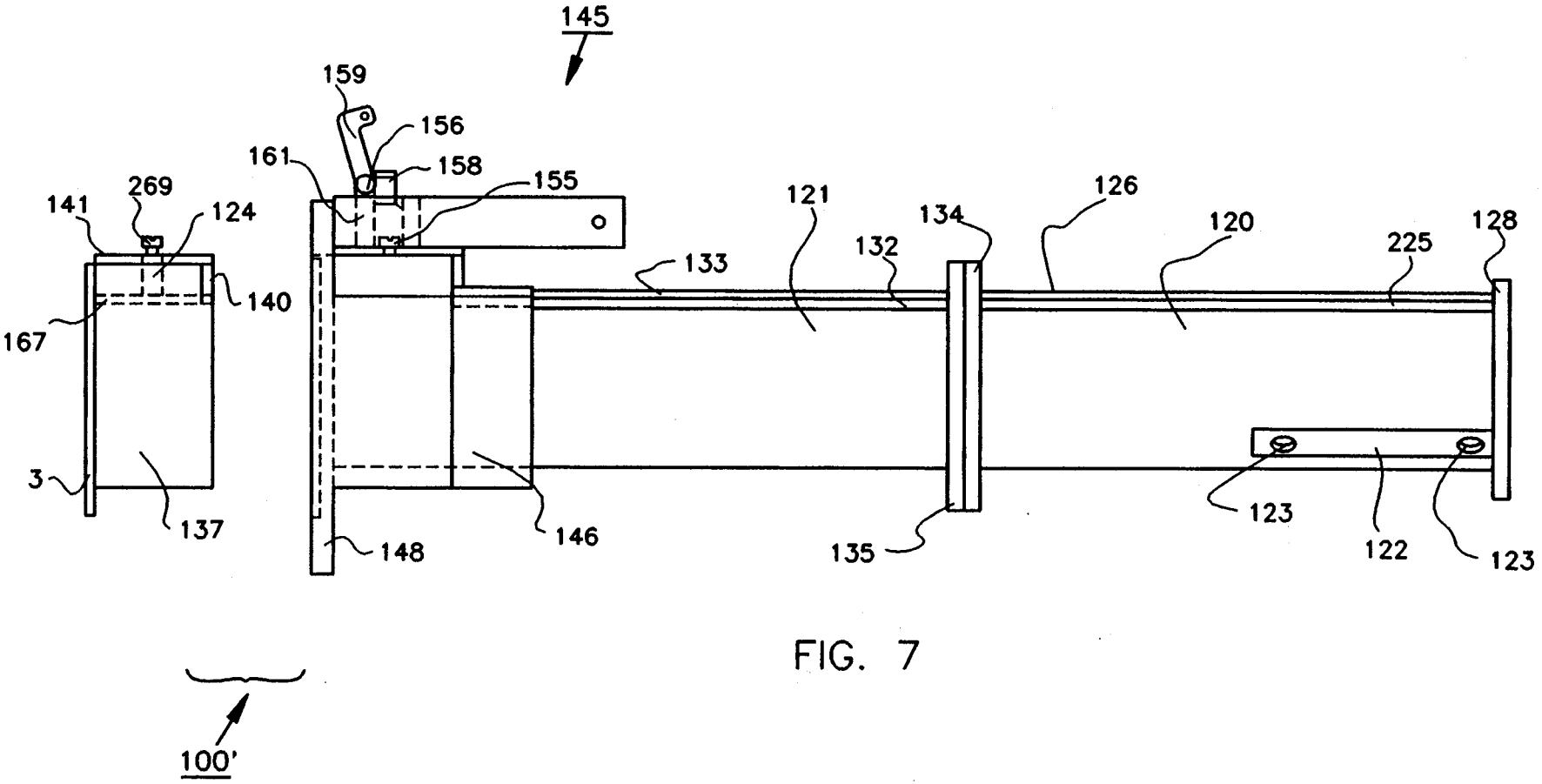
FIG. 7 is an elevated side view of a preferred VOLCANO breech and launcher tube assembly for control-input launching VOLCANO mines.
Figure 10:
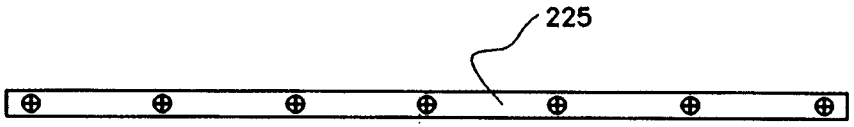
FIG. 10 is a plan view of a spacer for the tube of FIG. 8.

VOLCANO mines have a timer assembly 110 attached to the face of the mine that creates an oblong area on the circumference of the mine body, as depicted in FIG. 6. One step in the arming sequence of the mine is to allow a trigger pin 111 to protrude from the oblong area, a function normally accomplished in the field as the mine escapes a close fitting launch tube. Due to the arming sequence timing constraints in the tests for the control-impact launch configuration, a modified VOLCANO launch tube is provided which has a keyway 112 to allow the triggering pin 111 to be released before the mine leaves the launch tube. This configuration is shown in FIGS. 7–31.

Figure 11:
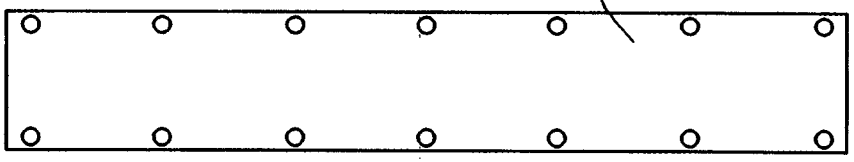
FIG. 11 is a plan view of a cover plate for the tube of FIG. 8.
Figure 12:
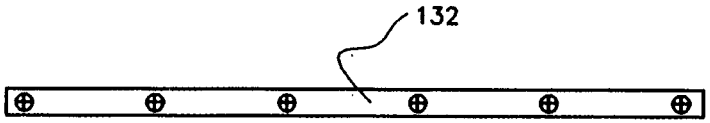
FIG. 12 is a plan view of a spacer for the tube of FIG. 9.
Figure 13:
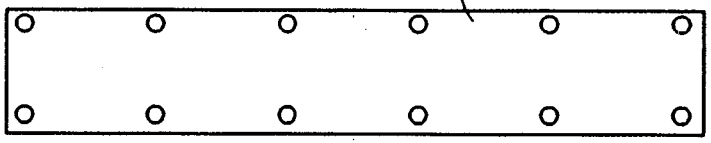
FIG. 13 is a plan view of a cover plate for the tube of FIG. 9.
Figure 8:
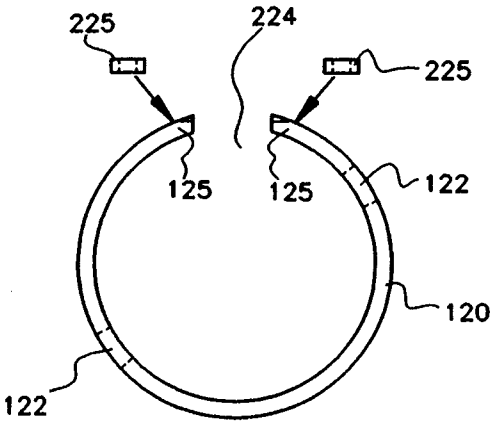
FIG. 8 is an end view of a forward tube for the launcher tube assembly of FIG. 7.
Figure 9:
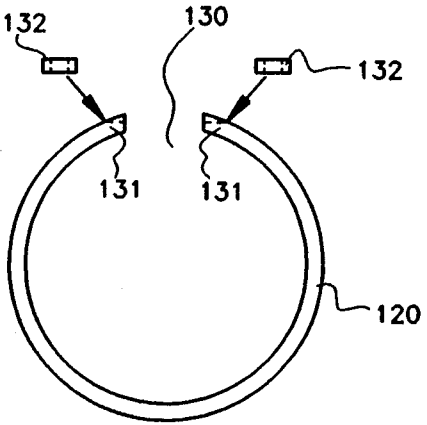
FIG. 9 is an end view of a rearward tube for the launcher tube assembly of FIG. 7.
Figure 17:
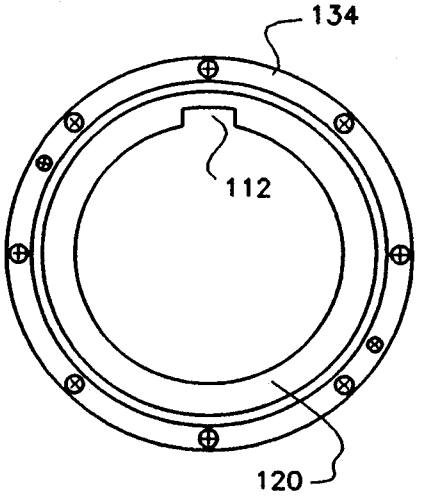
FIG. 17 is an elevated rear end view of the tube of FIG. 8.
Figure 18:
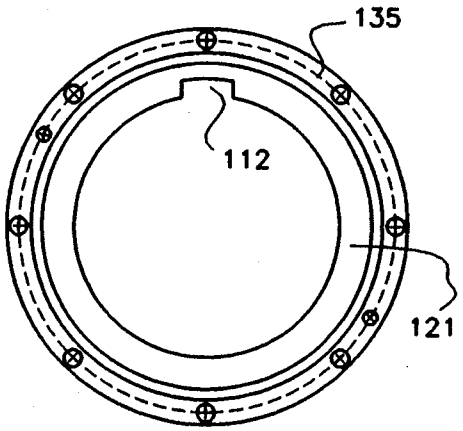
FIG. 18 is an elevated front end view of the tube of FIG. 9.
Figure 15:
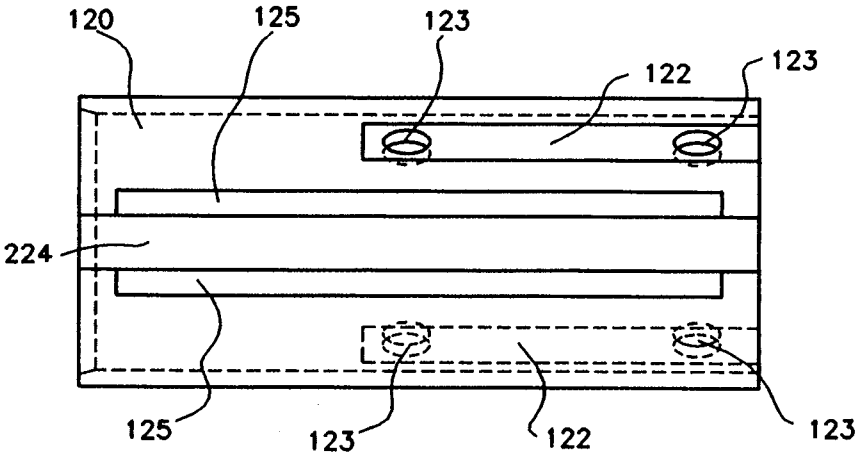
FIG. 15 is an elevated top view of the tube of FIG. 8.
Figure 14:
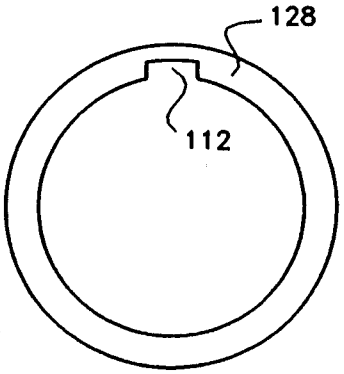
FIG. 14 is an elevated end view of an exit band for the tube of FIG. 8.
Figure 16:
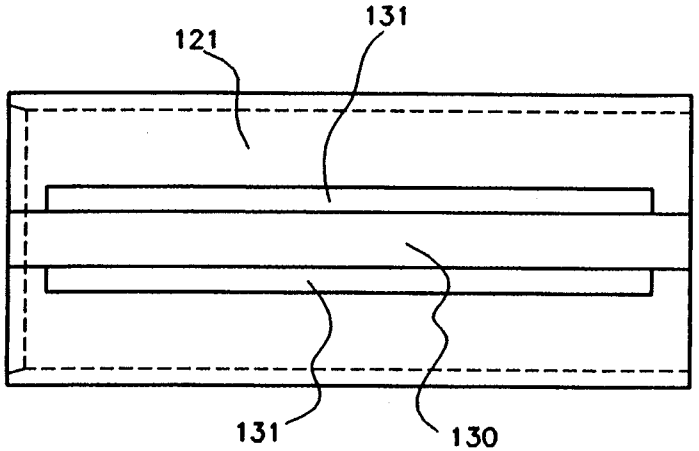
FIG. 16 is an elevated top view of the tube of FIG. 9.
Figure 21:
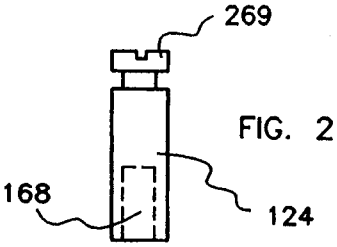
FIG. 21 is an elevated side view of a link for the breech assembly of FIGS. 19(*a*) and 19(*b*).
Figure 20A:
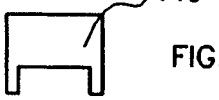
FIG. 20(*a*) is a plan view of the front side of a link housing for the breech assembly of FIG. 19(*a*) and 19(*b*).
Figure 20B:
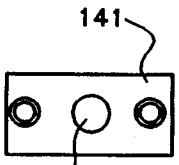
Figure 20C:
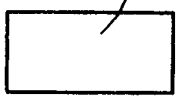
Figure 20D:
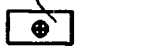
Figure 28C:
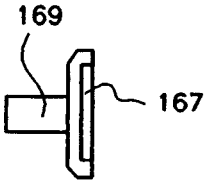
FIG. 28(*a*) is an elevated side view of a paddle for the lift block assembly of FIGS. 23 and 24.

In the VOLCANO control-impact launch configuration, the launch tube 100′ is formed from two flanged tubes 120 and 121 shown in cross-section in FIGS. 8 and 9. Flats Spacers 122 having tapped holes 123 for the velocity transducers 21–24 are provided at the forward or exit end of forward tube 120. Tube 120 includes a gap or slot 224, the edges of which are flattened at areas 125, as shown in FIGS. 8 and 11, to accommodate tapped mounting strips or spacers 225, shown in FIGS. 8 and 10, on which is fitted cover plate 126, shown in FIG. 11, to form a groove or slot of keyway 112. At the forward end of tube 100′ is a band 128, shown in FIG. 14, dimentioned to fit over end of forward tube 120. Rearward tube 121 also includes a gap 130, the edges of tube 121 having flattened areas 131, to accommodate mounting strips or spacers 132, shown in FIGS. 9 and 12, on which are fitted cover plate 133, illustrated in FIG. 13, to complete keyway 112. FIGS. 17 and 18 show the manner in which tubes 120 and 121 are joined at flanges 134 and 135, and illustrate the keyway in cross-section.

Figure 19B:
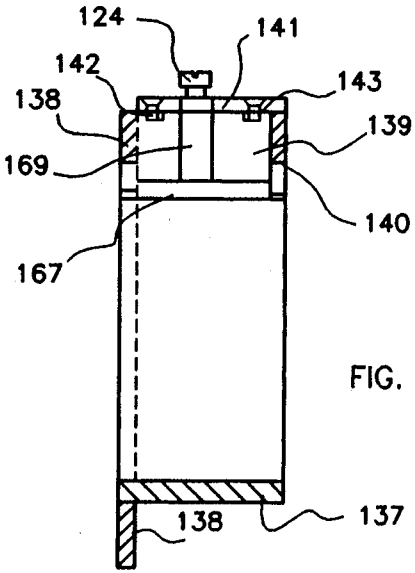
FIG. 19(*a*) is an elevated end view of a breech assembly for the VOLCANO control-impact launch configuration of FIGS. 7–18.
Figure 28B:
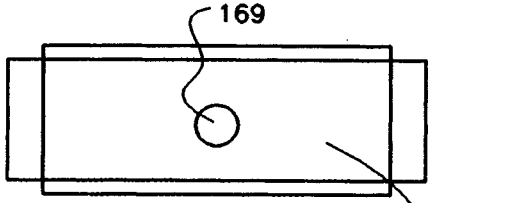
Figure 28A:
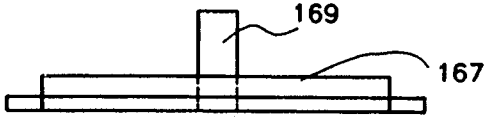
Figure 19A:
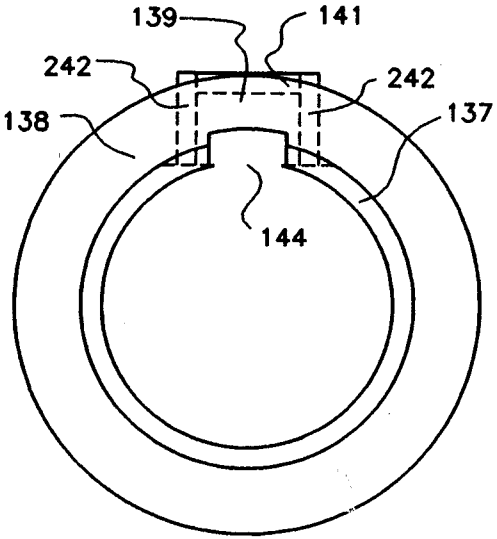
Figure 23:
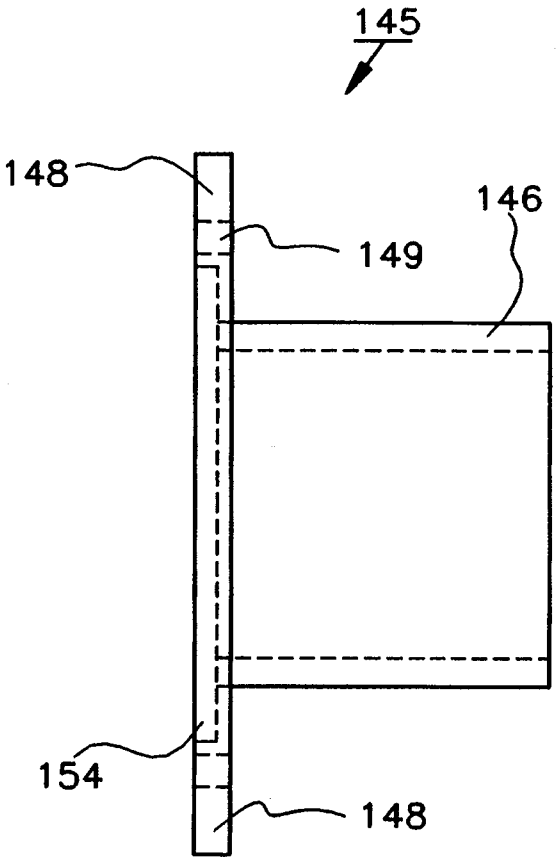
FIG. 23 is an elevated side view of the breech block of FIG. 22.
Figure 22:
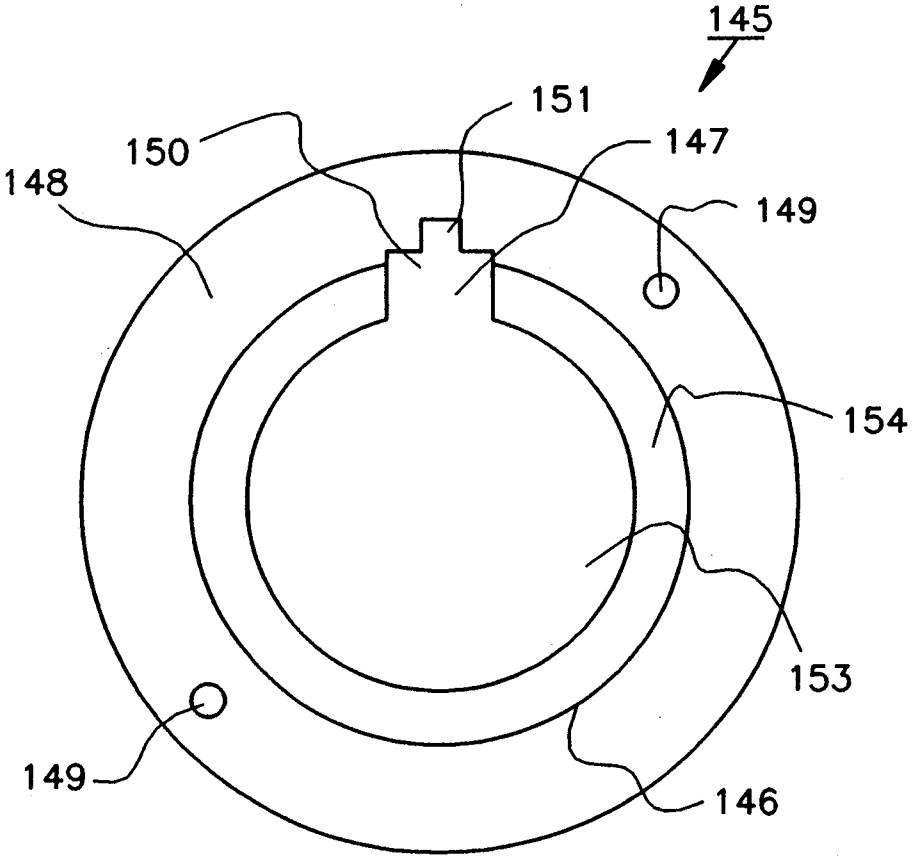
FIG. 22 is an elevated end view of a breech block for the VOLCANO control-impact launch configuration of FIGS. 7–18.
Figure 24:
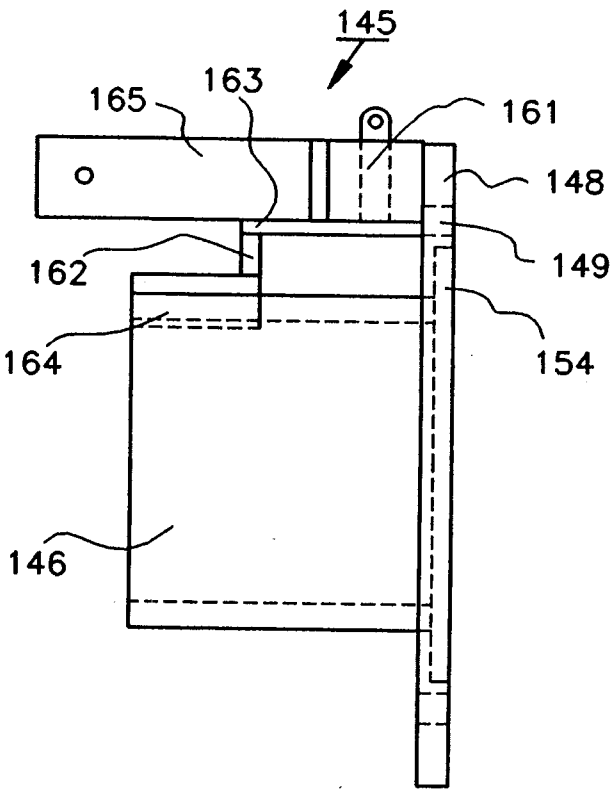
FIG. 24(*a*) is an elevated side view of the breech block of FIGS. 21 and 22, including a lift block assembly.
Figure 24:
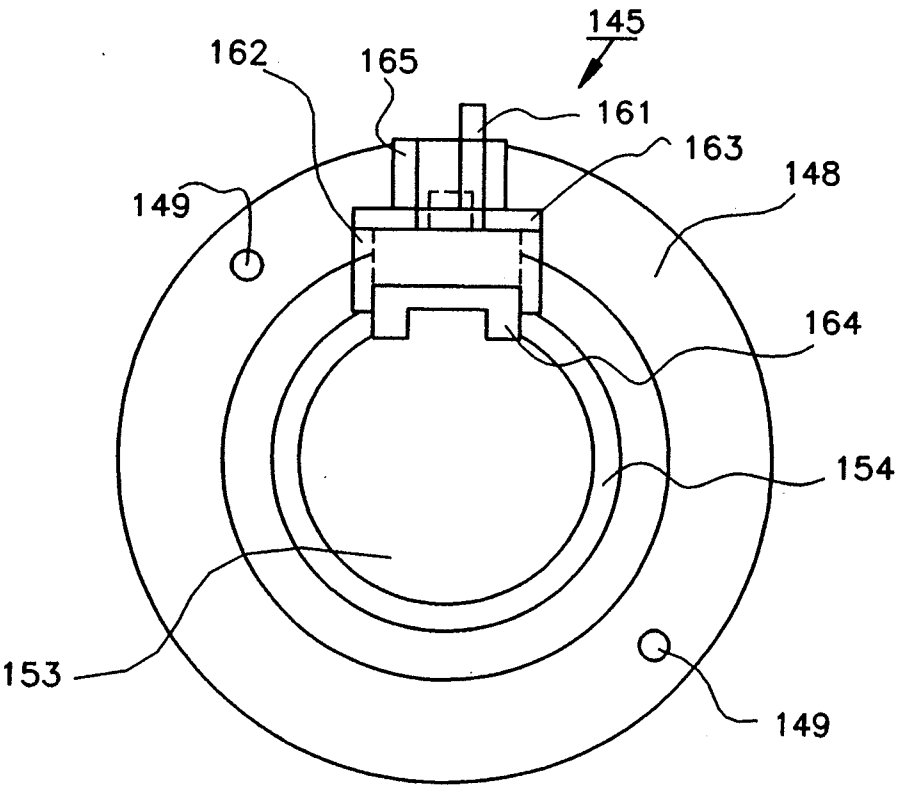
Figure 30:
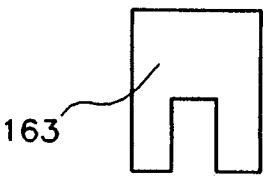
FIG. 30 is a plan view of a top piece for the lift block assembly of FIGS. 23 and 24.
Figure 29:
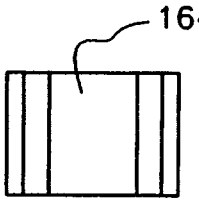
FIG. 29(*a*) is an elevated bottom view of a bottom piece for the lift block assembly of FIGS. 23 and 24.
Figure 29:
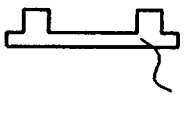
Figure 31:
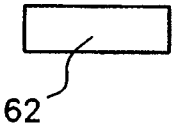
FIG. 31 is a plan view of a side piece for the lift block assembly of FIGS. 23 and 24.
Figure 27:
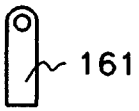
FIG. 27 is an elevated side view of a pivot for the cam of FIG. 26.

The interior surface of the rearward end of tube 121 is chamfered to permit insertion of breech assembly, which consists of a slotted ring 137 and flange 138, as shown in FIGS. 19(*a*) and 19(*b*). Extending over the slot 144 is a link housing 139 formed from end plate 140 and a portion of flange 138, top plate 141 being positioned on end plate 140 by cleats 142 and 143, and side plates 242, only one of which is shown, as depicted in FIGS. 20(*a*)–20(*d*). A hole 243 is provided for insertion of a link 124, shown in FIG. 21, opening 168 of which is threaded onto stud 169 of paddle 167, shown in FIGS. 28(*a*)–28(*c*), and which serves to hold timing trigger pin 11 prior to launch, as will be explained below.

The breech block 145 mounted on the end of tube 121, and shown in FIGS. 21–24, includes a ring 146 with a slot 147, a flange 148 having mounting/positioning holes 149, and grooves 151 and 152 for accommodating, respectively, link 124 and link housing 139 when the breech assembly is mounted on the launching tube within openings 153 and 154 of the breech block.

Figure 26:
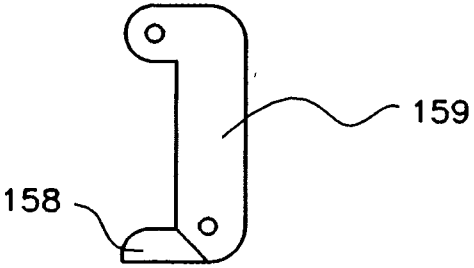
FIG. 26 is an elevated side view of a cam for the lift block assembly of FIGS. 23 and 24.
Figure 25:
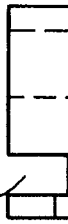
FIG. 25(*a*) is an elevated side view of a lift block for the lift block assembly shown in FIGS. 23 and 24.
Figure 25:
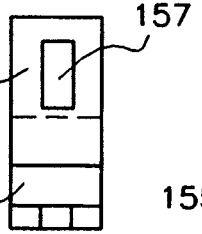

The triggering pin is held down prior to launch by link 124, the head 269 of which fits within a slot 155 provided in a lift block 156, shown in FIG. 25(*b*), of a bore rider release mechanism (BRRM) which, in turn, is moved up and down by engagement between aperture 157 and arm 158 of a cam 159, shown in FIG. 26. Cam 159 is pivotally mounted on the breech block by a pivot 161, shown in FIG. 27, which is supported by sides 162, top piece 163, and bottom piece 164, shown respectively in FIGS. 31, 32, and 29(*a*) and (*b*). The BRRM also includes a side plate 165 seated on top of the block. The second end of cam 159 may be connected to a pneumatic or electro-magnetic cylinder or other actuating mechanism by a member whose horizontal motion causes lift block 156 to be moved vertically to permit link 124 to rise against a spring bias, thus permitting the timer triggering pin 111 to also be raised, actuating the timer mechanism for the VOLCANO arming sequence before launch if desired.

Figure 34:
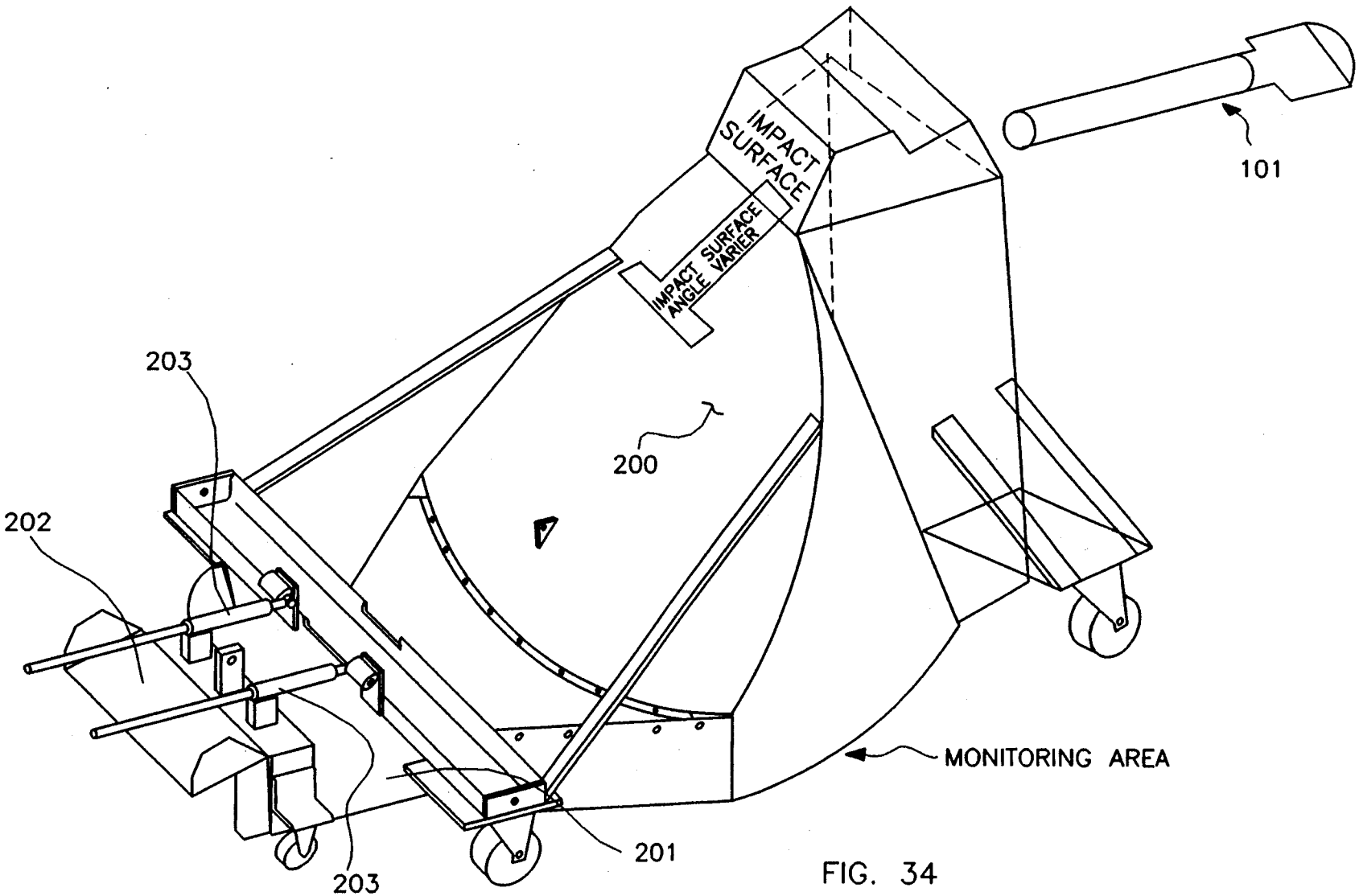
FIG. 34 is a perspective view of a control-impact configuration monitoring assembly arranged in accordance with the preferred embodiment of the invention.

In the control-impact configuration, the mine is launched into a chamber where it hits a wooden impact surface and drops through a chute to the monitoring area. Different angles of impact are achieved by adjusting the angles of the impact surface relative to the line of fire of the launched mine. The wooden impact surface, for example, a 4½ inch of particle board, is replaced for each mine. FIG. 34 shows the mine trap and positioning assembly that is used to position the mine in or on the monitoring area for the various test requirements. Below the impact chamber is a chute 200 through which the mine is dropped. The mine trap and positioning assembly 201 is attached to the mouth of the chute. VOLCANO and MOPMS mines each have two separate mine configurations, one for anti-tank (AT) and another for anti-personnel (AP) mines. AT mines must be placed on a monitoring board underneath a set of target plates. The AT mine is launched into the impact chamber and drops to the trapping chamber, after which the launcher unit is backed up until the mine is in front of the pneumatic remotely controlled positioning guide 202. Air cylinders 203 are activated to lower the guide behind the mine and push it outward from the trap assembly. The launcher is then moved forward pushing the mine onto a monitoring board and under the target plate test unit.

Since AP mines do not require plate penetration tests, the pneumatic positioning assembly is not used. The trap is positioned directly over the monitoring board and the mine is launched and trapped on the board. An alternative method is used when testing mines that do not contain high explosive filler. Functions from these mines can be monitored in enclosed wooden test cell boxes at an indoor test facility, in which case the mouth of the impact chamber fits into the top opening of the test cell box and the mine falls directly into the box.

Having thus described a specific preferred embodiment of the invention, it will be appreciated by those skilled in the art that variations are possible within the scope of the invention. Consequently, it is intended that the invention not be limited to the disclosed embodiments as illustrated in the drawings, but rather that they be defined solely in accordance with the appended claims.

We claim:

1. An individual mine launcher comprising:

a launch tube;

means including a breech assembly which fits within the launch tube for positioning a mine in the launch tube prior to launching;

means including a pressure chamber and a pneumatic launch activator for launching the mine from the launch tube;

means for monitoring the mine during launch and for monitoring impact of the mine after launch;

wherein the launch tube is mounted on a launcher comprising a launch vehicle separable from the launcher;

means including an arming coil on the launcher for arming the mine and means including a firing coil for causing said pneumatic launch activator to launch a mine from the launch tube.

2. Apparatus as claimed in claim 1, wherein the means for causing said pneumatic launch activator to launch a mine from the launch tube comprises a solenoid-operated air valve.

3. Apparatus as claimed in claim 1, further comprising quick disconnect cable means for connecting the firing coil and arming coil to a power distribution box located on the launch vehicle.

4. Apparatus as claimed in claim 1, further comprising a video camera on the launcher connected via a quick disconnect cable to a video monitor on the launch vehicle.

5. Apparatus as claimed in claim 1, wherein said launch tube and said breech assembly include flanges, and wherein said launch tube includes a cylindrical main body and respective openings in the body and flange of the body into which the breech assembly containing a mine is fitted prior to launch, and wherein said pressure chamber includes clamping means for clamping said chamber to said flange of said launch tube.

6. Apparatus as claimed in claim 1, wherein a pneumatic baseball pitching machine forms said pressure chamber and pneumatic launch actuator.

7. Apparatus as claimed in claim 1, wherein the launch tube is mounted on a breach and tube assembly by an adapter ring which has a microphone emplaced therein to monitor the mine for clicking sounds which occur in the arming sequence of the mine.

8. Apparatus as claimed in claim 7, further comprising quick disconnect cable means for transmitting the clicking sounds to said launch vehicle.

9. Apparatus as claimed in claim 1, including a velocity measuring system comprising four magnetic transducers mounted on the launching tube near the exit, said transducers being coupled to wave shaper circuits whose output triggers counters, two of the transducers being used for start time and two for stop time to enable redundant monitoring of mine launch velocity.

10. Apparatus as claimed in claim 9, wherein the wave shaper circuit is located on said launcher, the counters are located on the launch vehicle, and the output is connected to the counters by a quick disconnect cable.

11. Apparatus as claimed in claim 1, wherein said breech assembly includes a housing for supporting a link, and said launch tube includes a breech block on which is mounted a bore rider release mechanism.

12. Apparatus as claimed in claim 11, wherein said bore rider release mechanism includes means comprising a pivotally mounted cam which engages the slot in a lift block, the lift block engaging the link, for moving the link to release the triggering pin prior to launch.

13. Apparatus as claimed in claim 1, further comprising a chamber having an impact surface, a chute, and a monitoring area, the launch tube being positioned in a control-impact configuration to cause said mine to hit the impact surface and drop through the chute to the monitoring area.

14. Apparatus as claimed in claim 13, further comprising means for varying an angle of the impact surface relative to an angle of impact of the launched mine.

15. Apparatus as claimed in claim 13, wherein the mine is an anti-tank mine and further comprising a trap assembly between the chute and monitoring area, and positioning and guiding means for pushing the mine from the trap assembly onto a monitoring board in the monitoring area.

* * * * *